US005865193A

United States Patent [19]

Fukumoto

[11] Patent Number: 5,865,193

[45] Date of Patent: Feb. 2, 1999

[54] PERMANENT ROD TURNING DEVICE FOR USE IN PERMANENT WAVE

[76] Inventor: Kiyoaki Fukumoto, 81 Banchi, 3 choome, Kandaminami-dori, Amagasaki-shi, Hyougo-ken, Japan

[21] Appl. No.: 2,416

[22] Filed: Jan. 2, 1998

Related U.S. Application Data

[63] Continuation-in-part of Ser. No. 566,864, Dec. 4, 1995, abandoned.

[30] Foreign Application Priority Data

Dec. 29, 1994 [JP] Japan ..... 6-341087

[51] Int. Cl.[6] ..... A45D 6/02

[52] U.S. Cl. ..... 132/238

[58] Field of Search ..... 132/237, 238, 132/239, 240, 241, 267, 242, 264, 265, 266, 268

[56] References Cited

U.S. PATENT DOCUMENTS

| | | | |
|---|---|---|---|
| 1,756,265 | 5/1930 | Kunin et al. | 132/238 |
| 2,058,400 | 10/1936 | Behr | 132/264 |
| 2,549,530 | 4/1951 | Saucier | 132/266 |
| 3,463,169 | 8/1969 | Zaidan | 132/238 |
| 4,222,398 | 9/1980 | Fromman | 132/238 |

*Primary Examiner*—Gene Mancene
*Assistant Examiner*—Eduardo C. Robert

[57] ABSTRACT

A permanent rod turning device comprising a grip member having a motor disposed therein, a rod supporting shaft, and a substantially conical rod engaging member positioned on the rod supporting shaft adjacent to the grip member. The motor has a rotary shaft which extends outwardly from the grip member to a free distal end. The rod supporting rod extends coaxially from the free end of the rotary shaft. The conical rod engaging member has a disk-shaped base coaxially disposed upon the rod supporting shaft and a plurality of radially disposed engaging members protruding from the disk-shaped base longitudinally along the rod supporting shaft away from the grip member. Each engaging member has a generally inclined peripheral edge extending from the disk-shaped base toward a free end of the rod supporting shaft so as to permit permanent rods of various different diameters to be engaged therewith.

4 Claims, 3 Drawing Sheets

PERMANENT ROD TURNING DEVICE FOR USE IN PERMANENT WAVE

The present application is a CIP (Continuation In Part) application of the patent application Ser. No. 08/566,864 filed on Dec. 4, 1995 now abandoned.

BACKGROUND OF THE INVENTION

The present invention relates to a device for winding hair on permanent rods in which each rod is turned utilizing a driving force of a motor at the time of having one's hair permed.

Hitherto, for having one's hair permed, after washing, rinsing and other pre-treatment of the hair, the hair is wound on a plurality of hollow cylindrical resin rods of large and small diameters according to customer's desired hair style.

To wind the hair on the permanent rods, the hair is sliced by blocking with a permanent comb, and the sliced hair is wound on each rod together with a rod paper. Then, rubber rings are applied to a plurality of small protrusions provided at two ends of each rod so that the hair wound on the rods is pressed tightly onto the rods together with the rod paper.

Conventionally, all of such a series of winding steps have been carried out by a hairdresser while applying manually an adequate tension to the hair according to customer's desired hair style. Since the winding of hair on the permanent rods while applying manually an adequate tension to the hair is a very delicate and difficult work which exclusively depends on hairdresser's sense, experience and know-how, it has been necessary for a hairdresser to acquire skills and experience spending many years until reaching a certain level of finish in the aspect of dressing and styling satisfactory to the customer. Such a know-how is difficult to be transferred to a third party and must be acquired substantially through hairdresser's own experience, and therefore training and securing of capable hairdressers are rather serious problems in the field of hairdressing.

To overcome the mentioned problems, various permanent rod turning devices have been invented and put into practical use, as disclosed in the Japanese Laid-Open Utility Model Publication (unexamined) No. Hei 6-36501 and U.S. Pat. No. 4,222,398.

The Japanese Laid-Open Utility Model Publication (unexamined) No. Hei 6-36501 discloses a permanent rod turning device comprising a grip member 1 having motor 11 disposed therein, a rod supporting shaft 2 connected to a rotary shaft of the motor 11, and an elastic holder member 8, as shown in FIG. 7, and in which a sliced hair is held together with a rod paper between a rod 6 and the elastic holder member 8 on the rod supporting shaft 2, and by driving the motor to turn, the hair is wound on the rod 6.

The U.S. Pat. No. 4,222,398 discloses a permanent rod turning device comprising a grip member having a motor disposed therein, and a rotor detachably mounted on a rotary shaft of the motor, in which the mentioned motor is dome-shaped having its maximum diameter on the base side, and a plurality of raised portions are formed on outer peripheral surface of the rotor. It is described in this patent that the hair is wound on each rod by engaging the raised portions of the mentioned rotor with the engaged parts formed on ends of the rod, putting the sliced hair together with the rod paper on the peripheral surface of the rod, and driving the motor to turn.

In the mentioned prior arts, however, there exist following problems.

In the device disclosed in the Japanese Laid-Open Utility Model Publication (unexamined) No. Hei 6-36501, since the rod 6 is fixed by being held between the rod supporting shaft 2 and the elastic holder member 8, the rod 6 cannot be turned coaxially with the rotary shaft of the motor 11, but is turned in a manner of being swung around on an eccentric circular arc. As a result, the tension applied to the hair is not even but extremely irregular, making it impossible to carry out any turning of the rod suitable for practical use.

In the permanent rod turning device disclosed in the U.S. Pat. No. 4,222,398, since the mentioned rotor is dome-shaped and the raised portion have not a sufficient height, the rod may slip sideways making it difficult to engage the raised portions sufficiently with the engaged parts formed on the ends of the rod. As a result, it becomes impossible to turn the rod while maintaining a tension to the hair constant, which also results in a permanent rod turning device not suitable for practical use. Moreover, since rods useful in this patented invention are limited to only those engageable with the raised portions, there is no versatility and, in particular, the rod turning device according to this patented invention is quite useless for very small rods of which internal diameter is 3 to 4 mm.

Referring further to a difference in the aspect of construction and function between the device according to the U.S. Pat. No. 4,222,398 and that according to the present invention, in the device according to the U.S. Patent, upper part of the dome-shaped raised portions to engage with the ends of the rod is simply put in contact with the mentioned ends of the rod, which also results in indefinite engagement therebetween as described above.

On the other hand, in the device according to the present invention, the engaging member for engaging with the ends of the rod is solidly formed with the rod supporting shaft, and therefore when such a solidly formed engaging member is inserted in the hollow part of the rod to be engaged, top end of the rod supporting shaft serves as a guide for insertion in the hollow part of the rod, thus the ends of the rod and the engaging member are easily and securely engaged with each other.

SUMMARY OF THE INVENTION

Accordingly, it is an object of the present invention to provide a permanent rod turning device in which rod can be turned easily in a short time by a hairdresser whether or not well-experienced and skilled, and which has a versatility of adaptable to various types and sizes of rods, in particular, very small rods of 3 to 4 mm in internal diameter.

In the permanent rod turning device according to the invention, as any rod can be exactly engaged with a plurality of engaging members formed on the surface of a rod engaging member, the rod can be turned coaxially with the rotary shaft of the motor, whereby a rod can be turned in a manner suitable for practical use, while maintaining a tension to the hair constant.

Further, it is preferable that one engaging member or a pair of engaging members arranged at opposite positions on the surface of the rod engaging member are protruding more than the remaining engaging members toward the top end side, whereby various types of rods of which internal diameter is 3 to 20 mm can be utilized.

Furthermore, it is preferable that an elastic holder member arranged in parallel to the mentioned rod supporting shaft is formed solidly on a base part of the rod supporting shaft, whereby winding operation of the rod can be easily started.

Other objects, features, and advantages of the invention will become apparent in the course of the following description with reference to the accompanying drawings.

BRIEF DESCRIPTION OF THE DRAWINGS

FIG. 5 is a partially enlarged view showing a state that the large diameter rod is mounted on;

DESCRIPTION OF PREFERRED EMBODIMENTS

Several embodiments according to the invention are hereinafter described with reference to the drawings.

Figure 1:
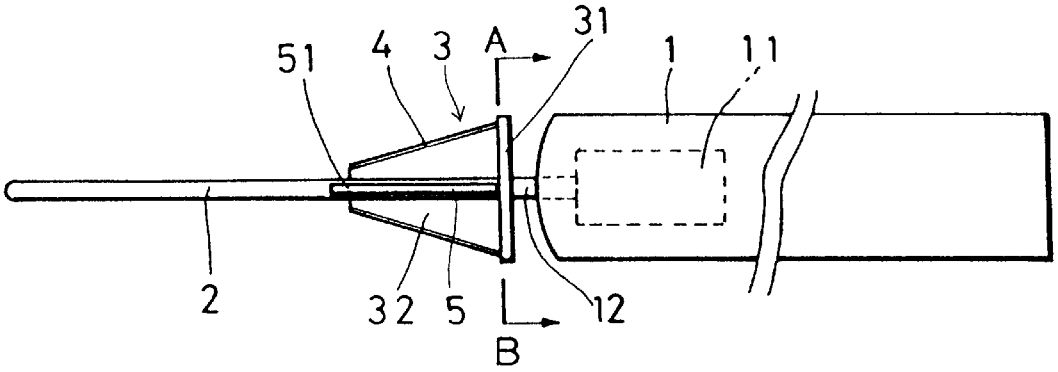
FIG. 1 is a schematic view showing a construction of an embodiment according to the present invention.

FIG. 1 is a schematic view showing a construction of a permanent rod turning device according to an embodiment of the invention. In the drawing, the permanent rod turning device comprises a grip member 1 having a drive source such as motor 11 disposed therein, a rod supporting shaft 2 connected coaxially to a rotary shaft 12 of the mentioned motor 11, and a rod engaging member 3 securely connected to the mentioned rod supporting shaft 2.

The rod engaging member 3 comprises a disk-shaped base part 31, an insertion part 32 formed conically so as to have a smaller diameter gradually reduced from the base part 31 side toward a top end, and a plurality of engaging members 4, 5 provided on the outer periphery of the insertion part 32.

Figure 2:
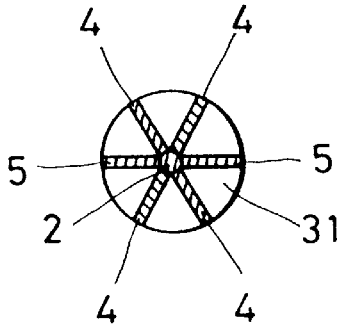
FIG. 2 is a sectional view taken along the line A–B of FIG. 1.

The mentioned engaging members 4, 5 are thin plates formed radially from the rod supporting shaft 2 so that height thereof is gradually smaller from the mentioned base part 31 toward the top end, and the engaging members 4, 5 are arranged so that one engaging member 4 is opposite to another engaging member 4 and one engaging member 5 is opposite to another engaging member 5, as shown in FIG. 2 which is a sectional view taken along the line A–B of FIG. 1. Each engaging member 5 is provided with a protruding part 51 protruding a little toward the rod center supporting shaft 2 side as compared with the engaging members 4.

Figure 3:
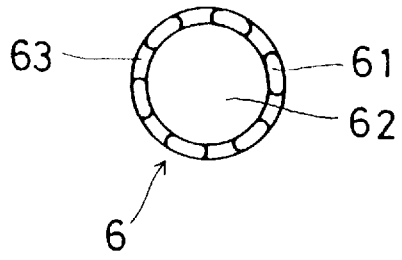
FIG. 3 is a schematic view showing a construction of an end of a large diameter rod.
Figure 4:
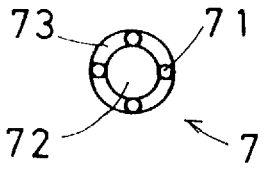
FIG. 4 is a schematic view showing a construction of an end of a small diameter rod.

The permanent rod turning device of above construction is put in use after mounting either rod 6 or rod 7 shown in FIGS. 3 and 4 on the rod engaging member 3.

Figure 5:
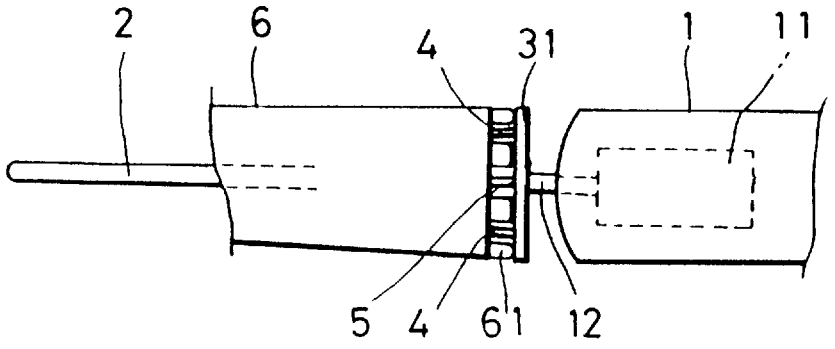

As shown in FIG. 3 showing a view from the end face side, the rod 6 comprises six small protrusions 61 and a hollow part 62 having almost the same diameter as that of the base part side of the insertion part 32, and by inserting the insertion part 32 in the hollow part 62 and inserting the mentioned engaging members 4 engagedly in gaps 63 formed between the mentioned small protrusions 61, the rod 6 is securely mounted on the permanent rod turning device. FIG. 5 shows a state that the large diameter rod is thus mounted on the permanent rod turning device.

On the other hand, as shown in FIG. 4, the rod 7 comprises four small protrusions 71 and a hollow part 72 having almost the same diameter as that of the rod supporting shaft 2, and by inserting the rod supporting shaft 2 in the hollow part 62 and inserting the protruding parts 51 of the engaging members 5 engagedly in gaps 73 formed between the mentioned small protrusions 71, the rod 7 is securely mounted on the permanent rod turning device.

After mounting the rod 6 or 7 on the permanent rod turning device, the sliced hair is fitted on the rod 6 or 7 together with a rod paper and wound on the rod 6 or 7 by driving the motor 11 to turn, then application of rubber rings or the like is carried out, thus a series of rod winding steps being completed.

As is obvious from the foregoing description, in the permanent rod turning device according to this embodiment, since the rod 6 or 7 is mounted on the rod engaging member 3 and can be turned coaxially with the rotary shaft 2 of the motor, a tension is evenly distributed on the hair, and therefore even a hairdresser not having enough experience can perform easily the winding of hair on the rod.

Furthermore, since the engaging members 4, 5 are used in their proper way corresponding to type of rod, the rods 6, 7 of different sizes can be used in one permanent rod turning device.

Figure 6:
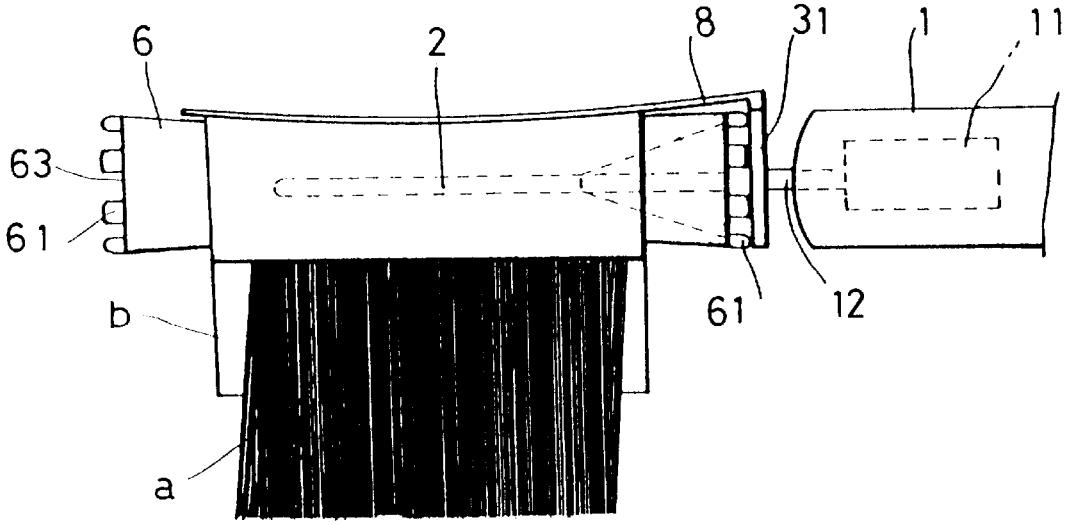
FIG. 6 is a schematic view showing a construction of another embodiment according to the invention.
Figure 7:
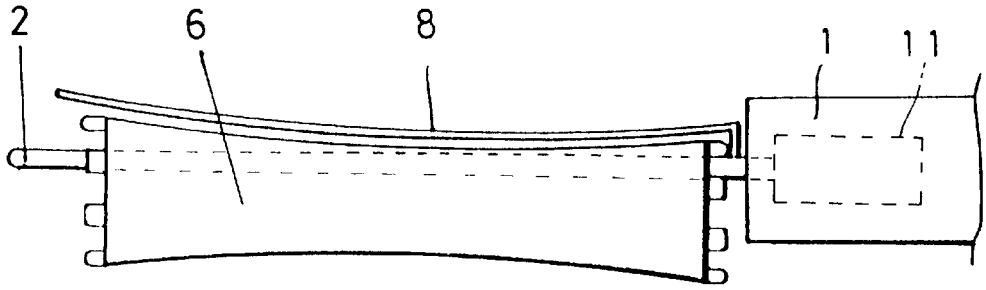
Fig.7 Prior Art
FIG. 7 is a schematic view showing a construction according to the prior art.

In addition to the foregoing embodiment, it is also preferred to provide an elastic holder member 8 which is formed solidly or detachably on the base part 31 of the rod engaging member 3 and arranged in parallel to the mentioned rod supporting shaft 2, as shown in FIG. 6.

In this second embodiment, the mentioned elastic holder member 8 is a long and slender member which is moderately urged onto the rod supporting shaft 2 side. As a result, a sliced hair "a" can be wound on the rod 6 while being held together with a rod paper "b" between the elastic holder member 8 and the rod 6.

In this manner, the start of winding hair on the rod which has been the most difficult step among the hair winding steps and has been narrowly carried out only by a skillful hairdresser capable of manipulating a permanent comb skillfully can be now carried out irrespective of the skill of the hairdresser.

What is claimed is:

1. A permanent rod turning device comprising:

a grip member having a motor disposed therein, said motor having a rotary shaft extending outwardly from said grip member to a free distal end;

a rod supporting shaft extending coaxially from said free end of said rotary shaft; and a substantially conical rod engaging member positioned on said rod supporting shaft adjacent to said grip member, said conical rod engaging member comprising a disk-shaped base coaxially disposed upon said rod supporting shaft adjacent said grip member and a plurality radially disposed engaging members protruding from said disk-shaped base longitudinally along said rod supporting shaft away from said grip member, said engaging members each having a generally inclined peripheral edge extending downwardly from said disk-shaped base toward a free end of said rod supporting shaft so as to permit permanent rods of various different diameters to be engaged therewith.

2. A permanent rod turning device as define in claim 1, further comprising an elongated elastic holder member protruding from said disk-shaped base and extending along said rod supporting shaft away from said grip member.

3. A permanent rod turning device as defined in claim 1, wherein at least one of said engaging members extends further along said rod supporting shaft than other engaging members.

4. A permanent rod turning device as define in claim 3, further comprising an elongated elastic holder member protruding from said disk-shaped base and extending along said rod supporting shaft away from said grip member.

* * * * *